US005804359A

United States Patent [19]

Simons

[11] Patent Number: 5,804,359

[45] Date of Patent: Sep. 8, 1998

[54] PHOTOGRAPHIC SILVER HALIDE MATERIALS

[75] Inventor: Michael John Simons, Ruislip, United Kingdom

[73] Assignee: Eastman Kodak Company, Rochester, N.Y.

[21] Appl. No.: 649,388

[22] Filed: May 17, 1996

[30] Foreign Application Priority Data

Jun. 17, 1995 [GB] United Kingdom ..... 9512364

[51] Int. Cl.[6] ..... G03C 1/46

[52] U.S. Cl. ..... 430/506; 430/502; 430/503; 430/551; 430/607; 430/264; 430/415; 430/448; 430/486; 430/374; 430/383

[58] Field of Search ..... 430/506, 503, 430/502, 551, 607, 264, 415, 448, 486, 374, 383

[56] References Cited

U.S. PATENT DOCUMENTS

| | | | |
|---|---|---|---|
| 4,258,117 | 3/1981 | Morgan et al. | 430/506 |
| 4,323,635 | 4/1982 | Oishi | 430/506 |
| 4,724,198 | 2/1988 | Yamada et al. | 430/506 |
| 4,965,179 | 10/1990 | Kuwashima et al. | 430/506 |
| 5,028,520 | 7/1991 | Ito | 430/567 |
| 5,190,850 | 3/1993 | Sakai et al. | 430/503 |
| 5,350,650 | 9/1994 | Gaspser et al. | 431/21 |
| 5,350,651 | 9/1994 | Evans et al. | 430/21 |
| 5,350,664 | 9/1994 | Simons | 430/21 |
| 5,368,983 | 11/1994 | Okamoto | 430/264 |
| 5,374,499 | 12/1994 | Sasaoka et al. | 430/264 |
| 5,389,503 | 2/1995 | Evans et al. | 430/502 |
| 5,391,443 | 2/1995 | Simons et al. | 430/21 |
| 5,399,469 | 3/1995 | Szajewski | 430/506 |
| 5,418,119 | 5/1995 | Simons | 430/507 |
| 5,420,003 | 5/1995 | Gasper et al. | 430/503 |

FOREIGN PATENT DOCUMENTS 0 452 848 A1 10/1991 European Pat. Off. .

OTHER PUBLICATIONS

*Research Disclosure*, vol. 365, Sep., 1994, Item 36544, XIX.
*Research Disclosure*, vol. 372, Apr. 1995, Item 37227.

*Primary Examiner*—Geraldine Letscher
*Attorney, Agent, or Firm*—Carl O. Thomas

[57] ABSTRACT

Photographic elements are disclosed in which exposure to at least one portion of the spectrum is recorded by a silver halide emulsion layer unit as an image having its optical density provided by silver. The layer unit is comprised of a plurality of radiation sensitive silver halide emulsion layers that are responsive to the same region of the spectrum, but differ in sensitivity, including a non-wandering silver halide reducing agent. A molar ratio of reducing agent to silver halide in one of the emulsion layers is less than that stoichiometrically required for complete silver halide reduction to silver. A higher molar ratio of reducing agent to silver halide is contained in a remaining of the two emulsion layers.

9 Claims, No Drawings

PHOTOGRAPHIC SILVER HALIDE MATERIALS

FIELD OF THE INVENTION

The invention relates to photographic materials which form images comprised substantially of silver, especially those which are capable of recording color information.

DEFINITION OF TERMS

The term "gamma" or "γ" is employed in its art recognized usage to indicate the change in density (D) divided by the change in log E, where E represents exposure in lux-seconds. Gamma is measured as the slope of the characteristic curve (a plot of density vs. log E) at a stated density or can be the average value determined over a stated density interval.

The term "auxiliary developing agent" is employed to designate a compound that in an aqueous alkaline medium is capable of promoting the development of silver halide to silver in the presence of a reducing agent by acting as an electron transfer agent between the silver halide and reducing agent.

The term "silver halide reducing agent" is employed to designate a compound capable of directly reducing silver halide to silver or indirectly reducing silver halide to silver by interacting with an auxiliary developing agent.

The term "non-wandering" is employed to indicate that a compound incorporated in a layer of a photographic element remains within the layer. Thus, a non-wandering compound is one that is either immobile or exhibits limited mobility as coated and during processing.

The term "color recording photographic element" is employed to indicate a photographic element that is capable of producing positive or negative records of the colors in a photographed subject.

*Research Disclosure* is published by Kenneth Mason Publications, Ltd., Dudley House, 12 North St., Emsworth, Hampshire P010 7DQ, England.

BACKGROUND OF THE INVENTION

The incorporation of silver halide reducing agents in silver image forming black-and-white films and papers is well known, as illustrated by *Research Disclosure,* Vol. 365, Sept. 1994, Item 36544, XIX. Development, A. Developing agents.

It is additionally well known to divide silver halide for recording imagewise exposures within a selected spectral region into a plurality of silver halide emulsion layers (usually two or three) differing in their sensitivities, as illustrated by *Research Disclosure,* Item 36544, I. Emulsion grains and their preparation, E. Blends, layers and performance categories, sub-paragraph (7).

Relatively recently interest has developed in constructing color recording photographic elements by employing one or more silver halide layer units that produce images that rely on silver for their optical density. Silver alone cannot, of course, produce a color record for direct viewing, but scanning techniques allow separate color records to be retrieved that can be used subsequently to produce a viewable color record of the subject photographed. Specific illustrations of photographic elements of this type are provided by the following:

| | |
|---|---|
| Gasper et al | U.S. Pat. No. 5,350,650, |
| Evans et al | U.S. Pat. No. 5,350,651, |
| Simons | U.S. Pat. No. 5,350,664, |
| Evans et al | U.S. Pat. No. 5,389,503, |
| Simons et al | U.S. Pat. No. 5,391,443, |
| Simons | U.S. Pat. No. 5,418,119, |
| Gasper et al | U.S. Pat. No. 5,420,003, |

Research Disclosure, Vol. 372, Apr. 1995, Item 37227.

SUMMARY OF THE INVENTION

In one aspect the invention is directed to a photographic element capable of forming a photographic image having its optical density provided by silver comprised of a support and, coated on the support, a plurality of radiation sensitive silver halide emulsion layers that are responsive to the same region of the spectrum, but differ in sensitivity, and non-wandering silver halide reducing agent contained in at least two of the emulsion layers, wherein a molar ratio of reducing agent to silver halide in one of the two emulsion layers of higher sensitivity is limited to from 1 to 25 percent of that stoichiometrically required to reduce to silver all of the silver halide in the one emulsion layer and a higher molar ratio of reducing agent to silver halide is contained in a remaining of the two emulsion layers.

In another aspect this invention is directed to a method of forming a photographic image having its optical density provided by silver employing an imagewise exposed photographic element according to the invention comprising contacting the photographic element with an aqueous alkaline solution.

It has been discovered quite unexpectedly that the photographic elements of the invention exhibit improved signal to noise (proportional to gamma÷granularity), exhibit reduced interimage effects, and exhibit gammas that remain stable over highly varied conditions of processing.

The invention is generally applicable to black-and-white photographic elements that rely on silver for image density. Within this class, the invention is particularly applicable to color recording photographic elements of the type that are used for retrieving color records by scanning.

DESCRIPTION OF PREFERRED EMBODIMENTS

In a simple form a photographic element satisfying the requirements of the invention can be constructed as follows:

| |
|---|
| Second AgX Emulsion Layer |
| First AgX Emulsion Layer |
| Support |
| PE-1 |

The support can be any conventional reflective or transparent photographic element support. It can, for example, take any of the forms disclosed in *Research Disclosure,* Item 36544, cited above, XV. Supports.

Coated on the support are first and second silver halide (AgX) emulsion layers that are sensitive to the same region of the spectrum. The first silver halide emulsion layer has a lower sensitivity (i.e., lower photographic speed) than the second silver halide emulsion layer.

The emulsion layers can take any of the conventional forms of emulsion layers found in photographic elements that form silver images—i.e., black-and-white photographic elements. The emulsion layers are free of dye image-forming components, such as dye image-forming couplers.

Incorporated within the emulsion layers are non-wandering silver halide reducing agents. The reducing agents can be immobile or exhibit limited mobility within the emulsion layer in which incorporated, but insufficient mobility to permit any significant fraction of the reducing agent to diffuse into adjacent layers prior to or during processing.

The non-wandering reducing agents are partitioned between the first and second emulsion layers in relation to the amount of silver contained in each layer. A lower molar ratio of reducing agent to silver halide is contained in the higher sensitivity emulsion layer (the second emulsion layer in PE-1) than in the lower sensitivity emulsion layer (the first emulsion layer in PE-1). The amount of reducing agent incorporated in the second emulsion layer is less than the stoichiometrically required amount to reduce all of the silver halide in the second emulsion layer to silver. Preferably the second emulsion layer contains from 1 (preferably 2) to 25 (preferably 15) percent of the amount of reducing agent stoichiometrically required to reduce completely the silver halide in the second emulsion layer to silver. The first silver halide emulsion layer preferably contains from 3 (most preferably 5 and optimally 10) to 50 (preferably 35 and optimally 25) percent of the amount of reducing agent stoichiometrically required to reduce completely the silver halide in the first emulsion layer to silver.

The total amount of silver halide coated in the first and second emulsion layers can be varied widely, depending upon the covering power of the silver halide emulsions employed and the imaging characteristics sought. For example, employing tabular grain emulsions (well known to exhibit high covering power, see Dickerson et al U.S. Pat. No. 4,414,304) in a photographic element intended to produce a maximum density of between 3.0 and 4.0, an optimum maximum density range for direct viewing of the image, it is seldom necessary to coat more than 30 mg/dm$^2$ of silver in an efficiently constructed and processed element. Since the eye is unable to discriminate well between varied optical densities exceeding 4.0, higher silver coverages are, of course, tolerable, but serve little useful purpose in obtaining images for direct viewing. However, scanning systems can be constructed to discriminate accurately between optical densities of >4.0. Fine nontabular grain emulsions, those having a mean grain equivalent circular diameter (ECD) of less than about 0.2 $\mu$m exhibit covering power characteristics comparable to tabular grain emulsions while coarse (mean ECD >0.6 $\mu$m) non-tabular grain emulsions can require up to twice the silver coating coverages of fine or tabular grain emulsions to realize comparable maximum densities. When a silver image is intended to be scanned, much lower levels of maximum density than are optically satisfying for direct viewing can be tolerated. Thus, a minimum total silver coating coverage for a single image record can be as low as 1.0 (preferably at least 3.0) mg/dm$^2$.

In partitioning silver halide between the first and second emulsion layers, any conventional partitioning can be employed. Typically the slower emulsion layer contains at least 25 percent of total silver and more typically at least 50 percent of total silver. The advantages of the invention are in evidence when the faster emulsion layer contains only a small fraction of total silver—for example, as low as 5 percent of total silver. It is generally preferred that the faster emulsion layer contain from 10 to 50 percent of total silver.

After the photographic element is imagewise exposed, it is brought into contact with an aqueous alkaline solution for development. If the non-wandering reducing agent has sufficient mobility, it can serve as the sole developing agent. In this instance the aqueous solution can take the form of any conventional activator solution used for the development of an incorporated developing agent photographic element.

It is preferred to bring the photographic element in contact with the aqueous alkaline solution in the presence of an auxiliary developing agent. The auxiliary developing agent is highly mobile and acts as an electron transfer agent between the non-wandering reducing agent and the silver halide being developed. The auxiliary developing agent can be incorporated in the aqueous alkaline processing solution, or it can be located within the photographic element at any convenient location, since its mobility allows it to migrate into the aqueous solution and throughout the emulsion layers during processing.

Post-development processing can take any convenient conventional form. Typically, the photographic element, after development in the aqueous alkaline processing solution, is placed in a stop bath, then a fix bath, and finally washed.

PE-1 above illustrates a minimum of layers. In practice it is preferred to provide additional, optional layers. Such a photographic element construction is illustrated by the following:

| |
|---|
| Surface Overcoat (SOC) Layer |
| Second AgX Emulsion Layer |
| First AgX Emulsion Layer |
| Undercoat Layer |
| Support |
| Pelloid |
| PE-2 |

The primary function of the surface overcoat (SOC) layer is to protect the underlying emulsion layers and to impart optimum physical handling features to the photographic element. The undercoat layer is a processing solution permeable layer that can be used to place various addenda within the photographic element. It is a common location for antihalation dye. Non-processing solution permeable layers, such as adhesion promoting layers, on the surface of the film or paper forming the support are regarded as part of the support. The pelloid is provided on the back side of the support to offset physical forces exerted by the layers coated on the front side of the support. The pelloid is frequently referred to as an anti-curl layer. The pelloid layer is processing solution permeable when it contains an antihalation dye, since such dyes are usually decolorized during processing. The pelloid layer provides one major surface of the photographic element and hence commonly also contains addenda for modifying physical handling properties of the photographic elements.

Referring to *Research Disclosure* Item 36544, cited above, conventional features of the various layers (and their contemplated locations) are illustrated by the following:

I. Emulsion grains and their preparation (AgX Emulsion Layers)

II. Vehicles, vehicle extenders, vehicle-like addenda and vehicle related addenda (All locations, except Support)

IV. Chemical sensitization (AgX Emulsion Layers)

V. Spectral sensitization and desensitization (AgX Emulsion Layers)

VII. Antifoggants and stabilizers (AgX Emulsion Layers)

VIII. Absorbing and scattering materials (Location dependent of function—e.g., anti-halation dyes are typically located in pelloid and undercoat; absorbing materials can be placed in emulsion layers to improve image sharpness and scattering materials can be placed in emulsion layers to increase speed.)

IX. Coating and physical property modifying addenda (SOC and pelloid)

Useful non-wandering reducing agents can be chosen from among a variety of conventional photographic addenda. In one form the reducing agents can be chosen from among limited mobility silver halide developing agents. Limited mobility developing agents are typically variations on conventional, mobile organic developing agents that additionally include one or more substituents to add bulk and reduce mobility. Organic developing agents include hydroquinones, catechols, aminophenols, pyrazolidinones, phenylenediamines, tetrahydroquinolines, bis(pyridone)amines, cycloalkenones, pyrimidines, reductones and coumarins. Examples of developing agents that can be substituted for restricted mobility (e.g., ballasted) are provided by *Research Disclosure* Item 36544, XIX. Development, A. Developing Agents.

Non-wandering reducing agents can also be chosen from among interlayer oxidized developing agent scavengers, non-wandering compounds that are conventionally employed in multiple dye image-forming photographic elements to prevent color contamination resulting from the migration of oxidized color developing agent between emulsion layer units sensitized to different spectral regions. These compounds are also commonly referred to as anti-stain agents. Examples of reducing agents of this type are provided by *Research Disclosure* Item 36544, X. Dye image formers and modifiers, D. Hue modifiers/stabilization. These compounds are typically similar to the organic developing agents of the types noted above and are ballasted by substitution to be rendered immobile during processing.

The auxiliary developing agents are mobile developing agents capable of accepting an electron from the non-wandering reducing agent and transferring the electron selectively to imagewise exposed silver halide grains. These compounds are commonly referred to as electron transfer agents. Many, but not all classes of organic developing agents are capable of functioning as electron transfer agents. Compounds useful as auxiliary developing agents in the practice of the invention have also been used to transfer electrons between immobile redox dye releasers (RDR's) and silver halide grains in dye image-forming photographic elements. Such compounds are illustrated, for example, in *Research Disclosure,* Vol. 151, November 1976, Item 15146. Preferred classes of auxiliary developing agents are p-aminophenols, p-phenylenediamines, reductones, and 3-pyrazolidinones.

The following illustrate specific contemplated auxiliary developing agents:

Aminophenols p-aminophenol
p-methylaminophenol
p-ethylaminophenol
p-dimethylaminophenol
p-dibutylaminophenol
p-piperidinophenol
4-methylamino-2,6-dimethoxyphenol 3-Pyrazolidinones 1-phenyl-3-pyrazolidinone
4,4-dimethyl-1-phenyl-3-pyrazolidinone
4-hydroxymethyl-4-methyl-1-phenyl-3-pyrazolidinone
4,4-bis(hydroxymethyl)-1-phenyl-3-pyrazolidinone
4,4-dimethyl-1-tolyl-3-pyrazolidinone
4,4-dimethyl-1-xylyl-3-pyrazolidinone
1,5-diphenyl-3-pyrazolidinone Phenylenediamines N-methyl-p-phenylenediamine
N-ethyl-p-phenylenediamine
N,N-dimethyl-p-phenylenediamine
N,N-diethyl-p-phenylenediamine
4-diethylamino-2,6-dimethoxyaniline Reductones piperidino-hexose-reductone
pyrrolidino-hexose-reductone In preferred applications of the invention the photographic elements can take the form of color recording photographic elements that produce color records without forming a dye image in at least one color recording layer unit. These photographic elements require at least three silver halide emulsion layer units each capable of recording exposures to a different one of the blue, green and red regions of the spectrum to allow the visible color information provided by the photographic subject to be recorded. Thus, the following structure is contemplated:

| |
|---|
| Surface Overcoat (SOC) Layer |
| Third AgX Emulsion Layer Unit |
| Interlayer |
| Second AgX Emulsion Layer Unit |
| Interlayer |
| First AgX Emulsion Layer Unit |
| Undercoat Layer |
| Support |
| Pelloid |
| PE-3 |

The SOC layer, undercoat, support and pelloid can take any of the forms described above. The interlayers are required in some embodiments, but not in others, as discussed below. At least one and preferably all of the first, second and third emulsion layers units contain two or more silver halide emulsion layers having the characteristics of emulsion layers, specifically the first and second AgX emulsion layers, described above in connection with PE-1 and PE-2. Each of the first, second and third emulsion layer units selectively records imagewise exposure in a different one of the blue, green and red portions of the visible spectrum.

One class of photographic elements of this type is disclosed by Simons et al U.S. Pat. No. 5,391,443, here incorporated by reference, which discloses a color recording photographic element in which N color records (N=2 in PE-3) are produced in emulsion layer units that produce dye images while an additional color record is produced in a remaining emulsion layer unit that produces only a silver image. Conventional interlayers for dye image-forming photographic elements are provided. Using scanning techniques the two separate dye image color records can be obtained while scanning in a spectral region in which only silver absorbs can provide a record of silver distribution in all of the emulsion layer units. By algebraic manipulation the silver image in the one emulsion layer unit not containing a dye image can be obtained. At least the silver image only forming emulsion layer unit is constructed according to the requirements of the invention.

Evans et al U.S. Pat. Nos. 5,350,651 and 5,389,503 and Simons U.S. Pat. No. 5,350,664 and 5,418,119, the disclosures of which are here incorporated by reference, disclose silver image only forming photographic elements. Reflective or absorbing interlayers are provided for assisting scan retrieval of the separate color records provided. The photographic element constructions of these patents are fully applicable to the practice of the invention. By employing two reflective interlayers, two absorptive interlayers or one reflective and one absorptive interlayer in combination in PE-3 together with the layer unit construction required by the invention in at least one and, preferably, all of the emulsion layer units, the advantages of this invention can be realized in these color recording photographic elements specifically adapted for scanning retrieval of the three separate color records.

Gasper et al U.S. Pat. Nos. 5,350,650 and 5,420,003, here incorporated by reference, disclose color recording photographic elements specifically adapted for scanning retrieval of three separate color records that differ from the photographic elements of the previous paragraph in that one of the absorptive interlayers exhibits fluorescent properties. That is, it absorbs scanning radiation and emits at a longer wavelength. Again, at least one and preferably all of the emulsion layer units can be constructed to satisfy the requirements of the invention as described above.

*Research Disclosure,* Item 37227, cited above, discloses a variation on Gasper et al in which one of the silver halide emulsion layers units forms a dye image. Again, at least one and preferably all of the emulsion layer units can be constructed to satisfy the requirements of the invention as described above.

EXAMPLES

The invention can be better appreciated by reference to the following specific embodiments.

Example 1

This example illustrates the granularity improvement given by the invention.

Blue-sensitive emulsion-containing layers were coated on cellulose triacetate film base as described below. Both contained similar amounts of four emulsions of graded sensitivity. Coating A represents a comparison coating in which all four emulsions and the reducing agent were coated in the same layer. Coating B is a coating according to the invention, having the most sensitive (fastest) emulsion in a separate layer which contained a lower ratio of reducing agent to silver halide than the layer containing the less sensitive emulsions.

The films were prepared by coating the following layers in order on cellulose triacetate film base. The layers are described in terms of coated laydown of each component in milligrams per square decimeter (mg/dm$^2$), except that the silver halide laydowns are described as milligrams of silver metal per square decimeter. The silver halide emulsions were of the tabular grain type, were silver bromoiodide having between 1 and 6 mole % iodide, and were sulfur-gold sensitized and spectrally sensitized to the blue region of the visible spectrum.

Coating A (control):

Layer 1: Gelatin underlayer Gelatin, 20 mg/dm$^2$

Layer 2: Combined emulsion layer Gelatin, 12 mg/dm$^2$

Fast blue-sensitive emulsion, 4.5 mg/dm$^2$ (ECD 3.2 $\mu$m, thickness 0.14 $\mu$m)

Mid blue-sensitive emulsion, 3.5 mg/dm$^2$ (ECD 1.1 $\mu$m, thickness 0.26 $\mu$m)

Slow blue-sensitive emulsion I, 2.5 mg/dm$^2$ (ECD 0.82 $\mu$m, thickness 0.09 $\mu$m)

Slow blue-sensitive emulsion II, 2.5 mg/dm$^2$ (ECD 0.53 $\mu$m, thickness 0.09 $\mu$m)

Developing agent DA, 4.5 mg/dm$^2$

Layer 3. overcoat Gelatin, 10 mg/dm$^2$ Hardener bis (vinylsulfonyl)methane, 0.8 mg/dm$^2$ The emulsion-containing layers also contained 4-hydroxy-6-methyl-1,3,3a,7-tetraazaindene, sodium salt, at 1.0 g/mole of silver, and surfactants used to aid the coating process.

Reducing agent DA was incorporated as a conventional photographic dispersion using diethyl lauramide as the oil-forming solvent.

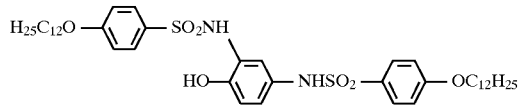

(DA)

Coating B:

The emulsions used were the same as in Coating A.

Layer 1: Gelatin underlayer Gelatin, 20 mg/dm$^2$

Layer 2: Slow emulsion layer Gelatin, 10 mg/dm$^2$ Mid blue-sensitive emulsion, 3.5 mg/dm$^2$ Slow blue-sensitive emulsion I, 2.5 mg/dm$^2$ Slow blue-sensitive emulsion II, 2.5 mg/dm$^2$ Reducing agent DA, 2.8 mg/dm$^2$ Layer 3: Fast emulsion layer Gelatin, 7 mg/dm$^2$ Fast blue-sensitive emulsion, 4.5 mg/dm$^2$ Reducing agent DA, 1.2 mg/dm$^2$ Layer 4. Gelatin supercoat Gelatin, 10 mg/dm$^2$ The emulsion-containing layers also contained 4-hydroxy-6-methyl-1,3,3a,7-tetraazaindene, sodium salt, at 1.0 g/mole of silver, and surfactants to aid in the coating process.

TABLE I

| Coating | Layer | DA ÷ AgX × 100 (molar ratio) |
|---|---|---|
| A | 2 | 4.48 |
| B | 2 | 4.61 |
| B | 3 | 3.73 |

AgX = silver halide.

Samples of the coatings were exposed to white light through a sensitometric step wedge. They were developed for 2 minutes by immersion with nitrogen burst agitation in the activator solution described below, then treated for 30 seconds in a 2% by volume acetic acid stop bath, then fixed for 2 minutes in Kodak A3000™ fixer solution diluted with 3 parts by volume water for each part of fixer, washed in running water, and dried.

Activator solution A

The following were dissolved in water and the solution made up to 1 liter:

| | |
|---|---|
| $Na_3PO_4.12H_2O$ | 80 g |
| $Na_2SO_3$ | 80 |
| sorbitol | 10 |
| 4-hydroxymethyl-4-1-phenyl-3-pyrazolidone | 1.0 |
| NaBr | 2.0 |

The pH was adjusted to 12.0 with dilute sulfuric acid.

The density and granularity of each image step of the film samples were measured through a 48 $\mu$m aperture by means of a scanning microscope. The photographic speeds of the two films were found to be very similar. Gamma and mid-scale granularity results showed the film of the invention, Coating B, to have a clearly superior signal to noise:

| | Gamma | Granularity | Gamma ÷ Granularity |
|---|---|---|---|
| Coating A: | 0.13 | 0.055 | 2.38 |
| Coating B | 0.17 | 0.045 | 3.85 |

Example 2

This example illustrates a color film containing incorporated developer according to the invention.

The film was prepared by coating the following layers in order on cellulose triacetate film base. The layers are described in terms of coated laydown of each component in milligrams per square decimeter (mg/dm$^2$), except that the silver halide laydowns are described as milligrams of silver metal per square decimeter. The silver halide emulsions were of the tabular grain type, were silver bromoiodide having between 1 and 6 mole % iodide, and were sulfur-gold sensitized and spectrally sensitized to appropriate regions of the visible spectrum.

Layer 1: Antihalation underlayer Gelatin, 15 mg/dm$^2$ Antihalation dye 0.8 mg/dm$^2$ (as a dispersion of solid dye. The dye was a neutral colored absorber dye which dissolved out of the coating when treated with an alkaline processing solution).

Layer 2: Slow red sensitive layer Gelatin, 16 mg/dm$^2$ Mid-speed red sensitive emulsion, 2.7 mg/dm$^2$ (ECD 1.22 $\mu$m, thickness 0.12 $\mu$m) Slow red sensitive emulsion, 4.0 mg/dm$^2$ (ECD 1.06 $\mu$m, thickness 0.09 $\mu$m) Slow red sensitive emulsion, 4.0 mg/dm$^2$ (ECD 0.53 $\mu$m, thickness 0.09 $\mu$m) Reducing agent DA, 5.0 mg/dm$^2$ Layer 3: Fast red sensitive layer Gelatin, 13 mg/dm$^2$ Fast red sensitive emulsion, 9.0 mg/dm$^2$ (ECD 3.0 $\mu$m, thickness 0.12 $\mu$m) Reducing agent DA, 2.0 mg/dm$^2$ Layer 4: Interlayer Gelatin, 28 mg/dm$^2$ Red-emitting fluorescent dye RF, 2.5 mg/dm$^2$ (RF was Lumogen Red 300, supplied by BASF Aktiengesellschaft, and was a red colored fluorescent dye with peak emission at 610 $\mu$m. It was dissolved as a 10% w/w solution in tricresyl phosphate, and the solution dispersed in the normal way into aqueous gelatin solution).

Layer 5: Slow green-sensitive layer Gelatin, 16 mg/dm$^2$ Mid green-sensitive emulsion, 2.5 mg/dm$^2$ (ECD 1.22 $\mu$m, thickness 0.12 $\mu$m) Slow green sensitive emulsion, 4.0 mg/dm$^2$ (ECD 1.06 $\mu$m, thickness 0.09 $\mu$m) Slow green sensitive emulsion, 5.0 mg/dm$^2$ (ECD 0.53 $\mu$m, thickness 0.09 $\mu$m) Reducing agent DA, 5.5 mg/dm$^2$ Layer 6: Fast green sensitive layer Gelatin, 10 mg/dm$^2$ Fast green sensitive emulsion, 8.0 mg/dm$^2$ (ECD 2.30 $\mu$m, thickness 0.12 $\mu$m) Reducing agent DA, 1.5 mg/dm$^2$ Layer 7: Interlayer Gelatin, 8.0 mg/dm$^2$ Green-emitting fluorescent dye GF, 1.5 mg/dm$^2$ (GF was Lumogen Yellow S, supplied by BASF Aktiengesellschaft, and was a yellow colored fluorescent pigment having a peak emission at 520 nm. It was dispersed in 3% w/w gelatin solution by milling for 20 minutes in a "Dyno-Mill"® supplied by Willy A Bachofen AG Machinenfabrik of Basel, Switzerland). Yellow filter dye, 1.0 mg/dm$^2$ (as a dispersion of solid dye, which was soluble and hence dischargeable in alkaline processing solution).

Layer 8: Yellow sensitive layer Gelatin, 11.0 mg/dm$^2$ Fast blue sensitive emulsion, 2.0 mg/dm$^2$ (ECD 3.1 $\mu$m, thickness 0.14 $\mu$m) Mid blue sensitive emulsion, 1.7 mg/dm$^2$ (ECD 1.1 $\mu$m, thickness 0.11 $\mu$m) Slow blue sensitive emulsion, 2.7 mg/dm$^2$ (ECD 0.7 $\mu$m, thickness 0.08 $\mu$m) Slow blue sensitive emulsion, 2.7 mg/dm$^2$ (ECD 0.53 $\mu$m, thickness 0.09 $\mu$m) Reducing agent DA, 3.0 mg/dm$^2$ Hardener bis(vinylsulfonyl)methane, 1.5 mg/dm$^2$ Layer 9: Gelatin supercoat Gelatin, 10 mg/dm$^2$ The emulsion-containing layers also contained 4-hydroxy-6methyl-1,3,3a,7-tetraazaindene, sodium salt, at 1.5 g/mole of silver, and surfactants used to aid the coating process.

Samples of the coatings were exposed to white light through a sensitometric step wedge which was half covered along its length with a Wratten® 29 red filter, so half the width of the strip was exposed to a graduated white light exposure, and half to a similarly graduated red light exposure. The samples were developed for varying times with nitrogen burst agitation in the developer solutions described below, then treated for 30 seconds in a 2% by volume acetic acid stop bath, then fixed for 2 minutes in Kodak A3000™ fixer solution diluted with 3 volumes of water for each volume of fixer, washed in running water, and dried. The samples were bathed for 60 seconds in 0.01M hydrochloric acid, washed for 60 seconds, then dried, to remove a low level of strain due to residual spectral sensitizing dye.

TABLE II

| Layer | DA ÷ AgX × 100 (molar ratio) |
|---|---|
| 2 | 6.54 |
| 3 | 3.11 |
| 5 | 6.69 |
| 6 | 2.62 |
| 8 | 4.61 |

| Developer solution D76 | |
|---|---|
| $Na_2SO_3$ | 100 g/L |
| Metol ™ | 2.0 |
| hydroquinone | 5.0 |
| borax | 2.0 |

| Developer solution DX44F | |
|---|---|
| $Na_2SO_3$ | 80 g/L |
| L-ascorbic acid | 15 |
| tris(hydroxymethyl)aminomethane | 25 |
| 4-hydroxymethyl-4-methyl-1-phenyl 3 - pyrazolidinone (HMMF) | 0.5 |
| NaBr | 0.25 |

The pH was adjusted to 8.2 with dilute sulfuric acid.

| Activator solution AX49J | |
|---|---|
| $Na_3PO_4.12H_2O$ | 80 g/I |
| $Na_2SO_3$ | 80 |
| sorbitol | 10 |
| 4-hydroxymethyl-4-methyl-1-phenyl-3-pyrazolidinone (HMMP) | 1.0 |
| NaBr | 2.0 |

The pH was adjusted to 12.0 with dilute sulfuric acid.

The two developer solutions, D76 (a long-established black and white developer solution), and DX44F (an experimental formulation designed to reduce interimage effects), contained reducing agent in solution which could reduce oxidized Metol™ or 4-hydroxymethyl-4-methyl-1-phenylpyrazolidinone so that the coated incorporated reducing agent was not involved in development by those two solutions. Separate tests also showed that the pH of those two developer solutions was too low to activate adequately the coated incorporated reducing agent. Thus these two solutions provided comparative examples of normal development by a developer solution. The activator solution AX49J on the other hand contained no developing agent other than the HMMP electron transfer agent, and separate tests showed that this solution would only give significant development if an incorporated reducing agent was coated in the film to be developed, and preferably in the layer to be developed. Development of the coating by this solution thus represented an example of practice of the invention.

The red light diffuse transmission density corresponding to each step of the neutral (white light) exposure was read with a densitometer and the gamma of the resulting combined blue, green and red records measured from a graph of density vs log exposure. The densities of the red records arising from the white light and red light stepped exposures were read with a modified reflection densitometer which illuminated the film through the film base with green light (from a tungsten-halogen lamp filtered with a green dichroic filter) and measured through a red dichroic filter the diffuse light returning from the red-emitting fluorescent layer through the red image layer. The gammas of these red records were measured from density vs log exposure graphs, and the ratio of the gamma from the red separation exposure ($D_R$) to that from the neutral (white light) exposure ($D_N$) was calculated for each development condition. This ratio, $D_R/D_N$, represented a measure of the interimage effect suffered by the red-sensitive layer: a value of 1.0 meant that the red image was not affected by development of the other color records, while a value in excess of 1.0 meant that the development of the red layer was suppressed by development of the other, overlying, color records.

The results are summarized in Table III.

TABLE III

| Developer | Developing Time (min) | Gamma | $D_R/D_N$ |
|---|---|---|---|
| D76 | 4 | 0.52 | 1.55 |
| | 5 | 0.69 | 1.60 |
| | 7 | 0.80 | 1.40 |
| DX44F | 2 | 0.54 | 1.39 |
| | 3 | 0.72 | 1.54 |
| | 4 | 0.88 | 1.29 |
| | 5 | 0.90 | 1.18 |
| AX49J | 2 | 0.57 | 0.99 |
| | 2.5 | 0.63 | 1.06 |
| | 3 | 0.64 | 0.93 |
| | 4 | 0.65 | 1.01 |

It will be seen that the development process of the invention gave the benefits of substantially constant gamma with varying development time, and substantially no interimage effect on the red-sensitive layer.

Example 3

This example illustrates the effect of distributing the sulfonamidophenol reducing agent DA between the layers according to the invention.

Experimental films were prepared by coating the following layers in order on cellulose triacetate film base. The layers are described in terms of coated laydown of each component in milligrams per square decimeter (mg/dm$^2$), except that the silver halide laydowns are described as milligrams of silver metal per square decimeter. The silver halide emulsions were (a) of the tabular grain type, (b) silver bromoiodide having between 1 and 6 mole % iodide, based on silver, (c) were sulfur and gold sensitized, and (d) spectrally sensitized to the stated region of the visible spectrum. Two comparisons are given: blue-sensitive coatings C and D, and red-sensitive coatings E and F. In the first of each pair the faster layer has a lower ratio of reducing agent to silver than does the slower layer, in accordance with the invention. In the second of each pair for comparison the two layers have similar reducing agent to silver ratios.

COATINGS C AND D:

Layer 1, Slow emulsion layer: Gelatin, 12 mg/dm$^2$ Mid-speed blue-sensitive emulsion, 2.0 mg/dm$^2$ (ECD 0.80 $\mu$m, thickness 0.09 $\mu$m) Slow blue-sensitive emulsion, 4.0 mg/dm$^2$ (ECD 0.52 $\mu$m, thickness 0.09 $\mu$m) Reducing agent DA, 3.5 mg/dm$^2$ Layer 2, Fast emulsion layer: Gelatin, 10 mg/dm$^2$ Fast blue-sensitive emulsion, 5.0 mg/dm$^2$ (ECD 0.96 $\mu$m, thickness 0.26 $\mu$m) Reducing agent DA, 1.5 mg/dm$^2$ (coating C), and 3.0 mg/dm$^2$ (coating D)

Layer 3, Supercoat: Gelatin, 20 mg/dm$^2$

COATINGS E AND F:

Layer 1, Slow emulsion layer: Gelatin, 20 mg/dm$^2$ Mid-speed red-sensitive emulsion, 4.0 mg/dm$^2$ (ECD 1.04 $\mu$m, thickness 0.09 $\mu$m) Slow red-sensitive emulsion, 9.0 mg/dm$^2$ (ECD 0.52 $\mu$m, thickness 0.09 $\mu$m) Reducing agent DA, 4.0 mg/dm$^2$ Layer 2, Fast emulsion layer: Gelatin, 10 mg/dm$^2$ Fast red-sensitive emulsion, 12 mg/dm$^2$ (ECD 1.4 $\mu$m, thickness 0.12 $\mu$m) Reducing agent DA, 1.5 mg/dm$^2$ (coating E), and 3.7 mg/dm$^2$ (coating F)

Layer 3, Supercoat: Gelatin, 20 mg/dm$^2$

The emulsion-containing layers also contained 4-hydroxy-6-methyl-1,3,3a,7-tetraazaindene, sodium salt, at 1.0 g/mole of silver, and surfactants used to aid the coating process. Reducing agent DA was incorporated as a conventional photographic dispersion using diethyl lauramide as the oil-forming solvent.

Samples of the coatings were exposed to white light through a sensitometric step wedge. They were developed for 2 minutes by immersion with nitrogen burst agitation in the activator solution described below, then treated for 30 seconds in a 2% by volume acetic acid stop bath, then fixed for 2 minutes in Kodak A3000™ fixer solution diluted with 3 volumes of water for each volume of fixer, washed in running water, and dried. Activator solution AX49L was employed.

Activator Solution AX49L

The following were dissolved in water and the solution made up to 1 liter:

| | |
|---|---|
| $Na_3PO_4.12H_2O$ | 80 g |
| $Na_2SO_3$ | 80 |
| sorbitol | 10 |
| 4-hydroxymethyl-4-methyl-1-phenyl pyrazolidinone | 1.0 |
| NaBr | 2.0 |
| 6-nitrobenzimidazole | 0.02 |

The pH was adjusted to 12.0 with dilute sulfuric acid.

The density and granularity of each image step of the film samples were measured through a 48 $\mu$m aperture by means of a scanning microscope. The photographic speed of coating C was found to be very similar to that of Coating D, and of Coating E similar to that of Coating F. Gamma and granularity results are presented below, and show lower gamma-normalized granularity in the mid and upper density scale for the coatings having the preferred distribution of reducing agent according to the invention.

TABLE IV

| Coating | Layer | DA ÷ AgX × 100 (molar ratio) |
|---|---|---|
| C | 1 | 8.16 |
| C | 2 | 4.20 |

TABLE IV-continued

| | | |
|---|---|---|
| D | 1 | 8.16 |
| D | 2 | 8.39 |
| E | 1 | 4.30 |
| E | 2 | 1.75 |
| F | 1 | 4.30 |
| F | 2 | 4.31 |

| Exposure Step | Density | Gamma | Granularity | Gamma ÷ Granularity |
|---|---|---|---|---|
| | | Results: | | |
| | | Coating: C | | |
| 1 | 0.08 | | | |
| 2 | 0.08 | | | |
| 3 | 0.08 | | | |
| 4 | 0.10 | 0.065 | 0.0031 | 20.8 |
| 5 | 0.13 | 0.12 | 0.0035 | 34.5 |
| 6 | 0.19 | 0.20 | 0.0035 | 58.8 |
| 7 | 0.28 | 0.27 | 0.0037 | 74.1 |
| 8 | 0.41 | 0.32 | 0.0039 | 82.1 |
| 9 | 0.53 | 0.28 | 0.0030 | 93.5 |
| 10 | 0.62 | 0.19 | 0.0027 | 71.4 |
| | | Coating: D | | |
| 1 | 0.06 | | | |
| 2 | 0.06 | | | |
| 3 | 0.06 | | | |
| 4 | 0.08 | 0.06 | 0.0030 | 19.6 |
| 5 | 0.12 | 0.14 | 0.0040 | 35.7 |
| 6 | 0.21 | 0.25 | 0.0043 | 58.8 |
| 7 | 0.32 | 0.32 | 0.0046 | 69.9 |
| 8 | 0.46 | 0.34 | 0.0044 | 77.5 |
| 9 | 0.58 | 0.29 | 0.0038 | 75.2 |
| 10 | 0.68 | 0.20 | 0.0033 | 60.6 |
| | | Coating: E | | |
| 1 | 0.15 | | | |
| 2 | 0.15 | | | |
| 3 | 0.16 | | | |
| 4 | 0.20 | 0.21 | 0.0048 | 43.5 |
| 5 | 0.33 | 0.34 | 0.0044 | 78.1 |
| 6 | 0.45 | 0.37 | 0.0039 | 95.2 |
| 7 | 0.62 | 0.36 | 0.0041 | 87.0 |
| 8 | 0.72 | 0.25 | 0.0032 | 79.4 |
| 9 | 0.82 | 0.21 | 0.0029 | 74.1 |
| 10 | 0.90 | 0.19 | 0.0021 | 92.6 |
| | | Coating: F | | |
| 1 | 0.14 | | | |
| 2 | 0.14 | | | |
| 3 | 0.16 | | | |
| 4 | 0.18 | 0.24 | 0.0646 | 52.6 |
| 5 | 0.38 | 0.57 | 0.0070 | 82.0 |
| 6 | 0.57 | 0.46 | 0.0060 | 76.9 |
| 7 | 0.74 | 0.41 | 0.0657 | 71.4 |
| 8 | 0.89 | 0.28 | 0.0048 | 58.1 |
| 9 | 0.98 | 0.27 | 0.0042 | 64.1 |
| 10 | 1.12 | 0.32 | 0.0039 | 82.0 |

Example 4

This example illustrates the effect of distributing the sulfonamidophenol reducing agent DA between the layers according to the invention. In this case the fast layer was coated over separate mid and slow speed layers.

Experimental films were prepared by coating the following layers in order on cellulose triacetate film base. The layers are described in terms of coated laydown of each component in milligrams per square decimeter (mg/dm$^2$), except that the silver halide laydowns are described as milligrams of silver metal per square decimeter. The silver halide emulsions were of the tabular grain type, were silver bromoiodide having between 1 and 6 mole % iodide, and were sulfur-gold sensitized and spectrally sensitized to the green region of the spectrum.

Coatings G and H:

Layer 1, Slow emulsion layer: Gelatin, 12 mg/dm$^2$ Slow green-sensitive emulsion, 9.0 mg/dm$^2$ (ECD 0.52 $\mu$m, thickness 0.09 $\mu$m) Reducing agent DA, 2.4 mg/dm$^2$ Layer 2, Mid emulsion layer: Gelatin, 9.0 mg/dm$^2$ Fast-mid green-sensitive emulsion, 2.0 mg/dm$^2$ (ECD 1.2 $\mu$m, thickness 0.12 $\mu$m) Mid green-sensitive emulsion, 4.0 mg/dm$^2$ (ECD 1.04 $\mu$m, thickness 0.09 $\mu$m) Reducing agent DA, 1.3 mg/dm$^2$ Layer 3, Fast emulsion layer: Gelatin 10 g/m$^2$ Fast green-sensitive emulsion, 8.0 mg/dm$^2$ (ECD 2.2 $\mu$m, thickness 0.13 $\mu$m) Fast-mid green-sensitive emulsion, 2.0 mg/dm$^2$ (ECD 1.2 $\mu$m, thickness 0.12 $\mu$m) Reducing agent DA, 1.0 mg/dm$^2$ (coating G), or 2.5 mg/dm$^2$ (coating H)

Layer 4, Supercoat: Gelatin, 20 mg/dm$^2$

The emulsion-containing layers also contained 4-hydroxy-6-methyl-1,3,3a,7-tetraazaindene, sodium salt, at 1.0 g/mole of silver, and surfactants used to aid the coating process.

Reducing agent DA was incorporated as a conventional photographic dispersion using diethyl lauramide as the oil-forming solvent.

Samples of the coatings were exposed to white light through a sensitometric step wedge. They were developed for 2 minutes by immersion with nitrogen burst agitation in activator solution AX49L, then treated for 30 seconds in a 2% by volume acetic acid stop bath, then fixed for 2 minutes in Kodak A3000 TM fixer solution diluted 3 volumes of water for each volume of fixer, washed in running water, and dried.

The density and granularity of each image step of the film samples were measured through a 48 $\mu$m aperture by means of a scanning microscope. The photographic speeds of the two films were found to be very similar. Gamma and granularity results are presented below, and show lower gamma-normalized granularity in the mid and upper density scale for the coating (G) having the preferred distribution of developing agent according to the invention.

TABLE V

| Coating | Layer | DA ÷ AgX × 100 (molar ratio) |
|---|---|---|
| G | 1 | 3.73 |
| G | 2 | 3.03 |
| G | 3 | 1.40 |
| H | 1 | 3.73 |
| H | 2 | 3.03 |
| H | 3 | 3.50 |

| Exposure Step | Density | Gamma | Granularity | Gamma ÷ Granularity |
|---|---|---|---|---|
| | | Results: | | |
| | | Coating: G | | |
| 1 | 0.13 | | | |
| 2 | 0.13 | | | |
| 3 | 0.14 | | | |
| 4 | 0.22 | 0.22 | 0.0063 | 34.5 |
| 5 | 0.30 | 0.22 | 0.0046 | 47.6 |
| 6 | 0.40 | 0.27 | 0.0044 | 60.6 |
| 7 | 0.50 | 0.22 | 0.0038 | 58.8 |
| 8 | 0.57 | 0.19 | 0.0033 | 56.5 |
| 9 | 0.65 | 0.19 | 0.0028 | 67.6 |
| 10 | 0.71 | 0.17 | 0.0022 | 77.5 |
| | | Coating: H (control) | | |
| 1 | 0.13 | | | |
| 2 | 0.13 | | | |

TABLE V-continued

| | | | | |
|---|---|---|---|---|
| 3 | 0.15 | | | |
| 4 | 0.25 | 0.33 | 0.0083 | 40.0 |
| 5 | 0.39 | 0.33 | 0.0059 | 55.6 |
| 6 | 0.51 | 0.29 | 0.0052 | 55.6 |
| 7 | 0.61 | 0.25 | 0.0049 | 51.3 |
| 8 | 0.71 | 0.22 | 0.0041 | 52.6 |
| 9 | 0.79 | 0.19 | 0.0035 | 53.5 |
| 10 | 0.87 | 0.22 | 0.0032 | 70.4 |

Example 5

This example illustrates the effect of distributing two other classes of non-wandering reducing agents between the emulsion layers according to the invention. The reducing agents used were DB, a hydrazide, and DC, a hydroquinone.

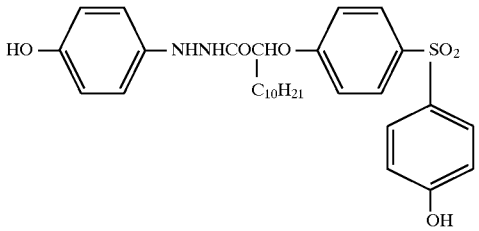

(DB)

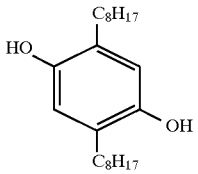

(DC)

Experimental films were prepared by coating the following layers in order on cellulose triacetate film base. The layers are described in terms of coated laydown of each component in milligrams per square decimeter (mg/dm$^2$), except that the silver halide laydowns are described as milligrams of silver metal per square decimeter. The silver halide emulsions were (a) of the tabular grain type, (b) silver bromoiodide containing between 1 and 6 mole % iodide, based on silver, (c) sulfur and gold sensitized, and (d) spectrally sensitized to the red region of the spectrum.

Two coatings are described for each developing agent: in each case, the silver laydowns in the two layers (fast and slow) are the same, the total laydowns of reducing agent are the same, but the distributions of developer between the two layers varied.

COATINGS I AND J:

Layer 1, Slow emulsion layer: Gelatin, 20 mg/dm$^2$ Mid red-sensitive emulsion, 4.0 mg/dm$^2$ (ECD 1.04 $\mu$m, thickness 0.09 $\mu$m); Slow red-sensitive emulsion, 9.0 mg/dm$^2$ (ECD 0.52 $\mu$m, thickness 0.09 $\mu$m); Reducing agent DB, 6.0 mg/dm$^2$ (coating I), and 3.5 mg/dm$^2$ (coating J)

Layer 2, Fast emulsion layer: Gelatin, 16 mg/dm$^2$ Fast red-sensitive emulsion, 13 g/m$^2$ (ECD 1.4 $\mu$m, thickness 0.12 $\mu$m) Reducing agent DB, 1.5 mg/dm$^2$ (coating I), and 4.0 mg/dm$^2$ (coating J)

Layer 3, Supercoat: Gelatin, 20 mg/dm$^2$

The emulsion-containing layers also contained 4-hydroxy-6-methyl-1,3,3a,7-tetraazaindene, sodium salt, at 1.0 g/mole of silver, and surfactants used to aid the coating process.

Reducing agent DB was incorporated as a conventional photographic dispersion using di-n-butyl phthalate as the oil-forming solvent.

COATINGS K AND L:

These were the same as coatings I and J respectively, except they used incorporated reducing agent DC in place of DB.

Reducing agent DC was incorporated as a conventional photographic dispersion using di-n-butyl phthalate as the oil-forming solvent.

Samples of the coatings were exposed to white light through a sensitometric step wedge. They were developed for 2 minutes by immersion with nitrogen burst agitation in the activator solution described below, then treated for 30 seconds in a 2% by volume acetic acid stop bath, then fixed for 2 minutes in Kodak A3000™ fixer solution diluted with 3 volumes of water for each volume of fixer, washed in running water, and dried.

The density and granularity of each image step of the film samples were measured through a 48 $\mu$m aperture by means of a scanning microscope. The photographic speeds of the two films were found to be very similar. Gamma and granularity results are presented below, and show lower gamma-normalized granularity in the mid and upper density scale for the coatings having the preferred distribution of reducing agent according to the invention.

TABLE VI

| Coating | Layer | DA ÷ AgX × 100 (molar ratio) |
|---|---|---|
| I | 1 | 9.00 |
| I | 2 | 2.25 |
| J | 1 | 5.25 |
| J | 2 | 6.00 |

TABLE VII

| Coating | Layer | DA ÷ AgX × 100 (molar ratio) |
|---|---|---|
| K | 1 | 5.43 |
| K | 2 | 1.36 |
| L | 1 | 3.17 |
| L | 2 | 3.62 |

Results:

| Exposure Step | Density | Gamma | Granularity | Gamma ÷ Granularity |
|---|---|---|---|---|
| | | Coating: I | | |
| 1 | 0.09 | | | |
| 2 | 0.10 | | | |
| 3 | 0.11 | | | |
| 4 | 0.15 | 0.18 | 0.0032 | 55.9 |
| 5 | 0.27 | 0.38 | 0.0052 | 73.0 |
| 6 | 0.44 | 0.44 | 0.0052 | 84.7 |
| 7 | 0.60 | 0.41 | 0.0051 | 80.6 |
| 8 | 0.76 | 0.35 | 0.0049 | 71.9 |
| 9 | 0.89 | 0.35 | 0.0045 | 77.5 |
| 10 | 1.04 | 0.37 | 0.0041 | 89.3 |
| | | Coating: J (control) | | |
| 1 | 0.09 | | | |
| 2 | 0.09 | | | |
| 3 | 0.10 | | | |
| 4 | 0.20 | 0.36 | 0.0060 | 60.2 |
| 5 | 0.37 | 0.47 | 0.0064 | 74.1 |
| 6 | 0.55 | 0.40 | 0.0058 | 68.0 |
| 7 | 0.68 | 0.30 | 0.0051 | 59.2 |
| 8 | 0.81 | 0.33 | 0.0049 | 68.0 |
| 9 | 0.94 | 0.31 | 0.0047 | 66.7 |
| 10 | 1.04 | 0.23 | 0.0043 | 53.2 |
| | | Coating: K | | |
| 1 | 0.10 | | | |
| 2 | 0.10 | | | |
| 3 | 0.11 | | | |
| 4 | 0.14 | 0.12 | 0.0033 | 37.0 |

TABLE VII-continued

| | | | | |
|---|---|---|---|---|
| 5 | 0.21 | 0.24 | 0.0035 | 69.9 |
| 6 | 0.33 | 0.37 | 0.0056 | 65.4 |
| 7 | 0.49 | 0.39 | 0.0052 | 74.6 |
| 8 | 0.64 | 0.37 | 0.0053 | 69.9 |
| 9 | 0.80 | 0.42 | 0.0053 | 79.4 |
| 10 | 0.97 | 0.36 | 0.0048 | 75.8 |
| | | Coating: L (control) | | |
| 1 | 0.10 | | | |
| 2 | 0.10 | | | |
| 3 | 0.11 | | | |
| 4 | 0.15 | 0.22 | 0.0043 | 51.5 |
| 5 | 0.29 | 0.41 | 0.0049 | 83.3 |
| 6 | 0.45 | 0.38 | 0.0072 | 52.9 |
| 7 | 0.60 | 0.39 | 0.0065 | 59.9 |
| 8 | 0.75 | 0.33 | 0.0056 | 58.8 |
| 9 | 0.87 | 0.31 | 0.0051 | 60.2 |
| 10 | 1.00 | 0.33 | 0.0041 | 80.6 |

The invention has been described in detail with particular reference to preferred embodiments thereof, but it will be understood that variations and modifications can be effected within the spirit and scope of the invention.

What is claimed is:

1. A photographic element capable of forming a photographic image having its optical density provided by silver on development comprised of a support and, coated on the support, a plurality of radiation sensitive silver halide emulsion layers that are responsive to the same region of the spectrum, but differ in sensitivity, non-wandering silver halide reducing agent contained in at least first and second of the emulsion layers, the first emulsion layer being coated nearer to the support than the second emulsion layer, the second emulsion layer being of a higher sensitivity than the first emulsion layer, a molar ratio of reducing agent to silver halide in the second emulsion layer being limited to from 1 to 25 percent of that stoichiometrically required to reduce to silver all of the silver halide in the second emulsion layer, and by an amount sufficient to increase signal to noise a higher molar ratio of reducing agent to silver halide being contained in the first emulsion layer than in the second emulsion layer.

2. A photographic element according to claim 1 wherein the second emulsion layer of higher sensitivity contains from 2 to 15 percent of the reducing agent stoichiometrically required to reduce all of the silver halide present in the one emulsion layer.

3. A photographic element according to claim 1 wherein the first emulsion layer contains from 3 to 50 percent of the amount of the reducing agent stoichiometrically required to reduce all of the silver present in the remaining emulsion layer.

4. A photographic element capable of forming a photographic image having its optical density provided by silver on development comprised of a support and, coated on the support, a plurality of radiation sensitive silver halide emulsion layers that are responsive to the same region of the spectrum, but differ in sensitivity, non-wandering silver halide reducing agent contained in at least first and second of the emulsion layers, the first emulsion layer being coated nearer to the support than the second emulsion layer, the second emulsion layer being of higher sensitivity than the first emulsion layer, a molar ratio of reducing agent to silver halide in the first emulsion layer being from 10 to 50 percent of the amount of the reducing agent stoichiometrically required to reduce all of the silver present in the first emulsion layer, a molar ratio of reducing agent to silver halide in the second emulsion being limited to from 1 to 25 percent of that stoichiometrically required to reduce to silver all of the silver halide in the one emulsion layer, and by an amount sufficient to increase signal to noise a higher molar ratio of reducing agent to silver halide being contained in the first emulsion layer than in the second emulsion layer.

5. A color recording photographic element comprised of a support and, coated on the support, a sequence of superimposed blue, green and red recording silver halide emulsion layer units that produce images of the same hue upon processing, one of the emulsion layer units forming a first emulsion layer unit in the sequence coated nearest the support, another of the emulsion layer units forming a last emulsion layer unit in the sequence coated farthest from the support, and an intermediate emulsion layer unit located between the first and last emulsion layer units, and a first interlayer coated between the first emulsion layer unit and the intermediate emulsion layer unit capable of transmitting to the first emulsion layer unit electromagnetic radiation this emulsion layer unit is intended to record and a second interlayer coated between the intermediate emulsion layer unit and the last emulsion layer unit capable of transmitting to the first and intermediate emulsion layer units electromagnetic radiation these emulsion layer units are intended to record, the first and second interlayers each containing a material capable of, after photographic processing, either absorbing or reflecting scanning radiation within at least one wavelength region, at least one of the emulsion layer units containing a plurality of radiation sensitive silver halide emulsion layers that are responsive to the same region of the spectrum, but differ in sensitivity, and non-wandering silver halide reducing agent contained in at least first and second of the emulsion layers, wherein the second emulsion layer exhibits a higher sensitivity than the first emulsion layer and by an amount sufficient to increase signal to noise a lower molar ratio of reducing agent to silver halide is contained in the second emulsion layer than is contained in the first emulsion layer.

6. A color recording photographic element according to claim 5 wherein the material contained in the interlayer is a dye or a precursor of a dye capable of absorbing, after photographic processing, the scanning radiation.

7. A color recording photographic element according to claim 5 wherein the material contained in one of the interlayers is capable of absorbing electromagnetic radiation within at least one wavelength region and emitting electromagnetic radiation within a longer wavelength region.

8. A method of forming a photographic image having its optical density provided by silver employing an imagewise exposed photographic element according to any one of claims 1 to 7 inclusive comprising contacting the photographic element with an aqueous alkaline solution.

9. A method according to claim 8 wherein the photographic element is contacted with the aqueous alkaline solution in the presence of an auxiliary developing agent capable of acting as an electron transfer agent between the silver halide being reduced and the non-wandering reducing agent.

* * * * *